US011371525B2

(12) United States Patent
Kuang et al.

(10) Patent No.: US 11,371,525 B2
(45) Date of Patent: Jun. 28, 2022

(54) AIR TREATMENT EQUIPMENT, FAN AND CENTRIFUGAL FAN BLADE OF FAN

(71) Applicant: Gree Electric Appliances, Inc. of Zhuhai, Guangdong (CN)

(72) Inventors: Xixi Kuang, Guangdong (CN); Cheng Zeng, Guangdong (CN); Zhongmei Wei, Guangdong (CN); Weixue Lin, Guangdong (CN); Ge Yu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/259,945

(22) PCT Filed: May 17, 2019

(86) PCT No.: PCT/CN2019/087354
§ 371 (c)(1),
(2) Date: Jan. 13, 2021

(87) PCT Pub. No.: WO2020/015444
PCT Pub. Date: Jan. 23, 2020

(65) Prior Publication Data

US 2021/0270281 A1 Sep. 2, 2021

(30) Foreign Application Priority Data

Jul. 17, 2018 (CN) ..... 201810782248.6

(51) Int. Cl.
*F04D 29/30* (2006.01)
*F04D 29/28* (2006.01)
(Continued)

(52) U.S. Cl.
CPC ..... *F04D 29/281* (2013.01); *F04D 17/08* (2013.01); *F04D 17/16* (2013.01); *F04D 25/08* (2013.01);
(Continued)

(58) Field of Classification Search
CPC ..... F04D 17/16; F04D 29/281; F04D 29/30; F05D 2250/713
See application file for complete search history.

(56) References Cited

U.S. PATENT DOCUMENTS 6,007,300 A * 12/1999 Saeki ..... F04D 29/283 416/178
6,461,103 B2 * 10/2002 Kim ..... F04D 29/283 416/185
(Continued)

FOREIGN PATENT DOCUMENTS

CN 1546868 A 11/2004
CN 104251229 A 12/2014
(Continued)

*Primary Examiner* — Ninh H. Nguyen
(74) *Attorney, Agent, or Firm* — The Webb Law Firm

(57) ABSTRACT

The present disclosure provides a centrifugal fan blade, an air treatment device and a fan; the centrifugal fan blade includes a hub and a plurality of fan blades; the plurality of fan blades are distributed around the periphery of the hub; each fan blade includes a first blade and a second blade; moreover, the first blade is in a backward blade form; and the second blade is in a forward blade form. The centrifugal fan blade can improve the flowing of the airflow and improve the air output efficiency.

14 Claims, 2 Drawing Sheets

(51) Int. Cl.
*F04D 17/08* (2006.01)
*F04D 25/08* (2006.01)
*F04D 17/16* (2006.01)

(52) U.S. Cl.
CPC ..... *F04D 29/30* (2013.01); *F05D 2250/713* (2013.01)

(56) References Cited

U.S. PATENT DOCUMENTS

| | | | | |
|---|---|---|---|---|
| 6,769,876 | B2 * | 8/2004 | Sakai | F01D 1/02 415/206 |
| 8,337,157 | B2 * | 12/2012 | Kilian | F04D 29/283 415/203 |
| 10,100,839 | B2 * | 10/2018 | Kasahara | F04D 29/283 |
| 2020/0032654 | A1 | 1/2020 | Stonjek | |

FOREIGN PATENT DOCUMENTS

| | | | |
|---|---|---|---|
| CN | 206092502 | U | 4/2017 |
| CN | 108825552 | A | 11/2018 |
| CN | 208442081 | U | 1/2019 |
| DE | 102016218983 | A1 | 4/2018 |
| GB | 1059869 | | 2/1967 |
| KR | 1020050044972 | A | 5/2005 |
| WO | 2004101969 | A2 | 11/2004 |

* cited by examiner

AIR TREATMENT EQUIPMENT, FAN AND CENTRIFUGAL FAN BLADE OF FAN

CROSS-REFERENCE TO RELATED APPLICATIONS

This application is the United States national phase of International Application No. PCT/CN2019/087354 filed May 17, 2019, and claims the priority of Chinese Patent Application No. 201810782248.6, filed on Jul. 17, 2018 and titled with "Air Treatment Equipment, Fan and Centrifugal Fan Blade of Fan", the disclosures of which are hereby incorporated by reference in their entirety.

BACKGROUND OF THE INVENTION

Field of the Invention

The present disclosure relates to the technical field of air treatment, in particular to an air purification device, a fan and centrifugal fan blades of the fan.

Description of Related Art

In the disclosure of fans applied to the household appliance industry, with the improvement of people's quality of life, the requirements for indoor air quality are getting higher and higher, and the types of various filter elements and resistance components in air treatment device are increased. This poses a huge challenge to the static pressure resistance of the fans.

Currently, the air treatment device usually adopts forward centrifugal fans to guarantee the flowing of airflow. When a forward centrifugal fan is in use, the greater the angle between the exit angle of a blade and the tangential direction of an impeller, the stronger the static pressure resistance of the fan. However, the flow velocity of the airflow at the air outlet of the forward centrifugal fan is maximal, and the flow loss of the airflow is proportional to the second power of the flow velocity, so the flow loss of the airflow is large, resulting in low efficiency.

SUMMARY OF THE INVENTION

The present disclosure provides a centrifugal fan blade, including a hub and a plurality of fan blades, wherein said plurality of fan blades are distributed around the periphery of the hub; and each fan blade includes a first blade and a second blade; each first blade is in a backward blade form; and each second blade is in a forward blade form.

In some embodiments, the first blade and the second blade are connected in series.

In some embodiments, the first blade is connected with the hub, and the second blade is disposed away from the hub.

In some embodiments, the curvature radius of the first blade is greater than that of the second blade.

In some embodiments, the range of the ratio of the curvature radius of the first blade to the curvature radius of the second blade is 3.4 to 3.8.

In some embodiments, the blade entrance angle of the first blade ranges from 64.5° to 68.5°;

and/or, the blade exit angle of the second blade ranges from 16° to 20°.

In some embodiments, each fan blade further includes a connecting blade which smoothly connects the first blade with the second blade.

In some embodiments, the first blades of every two adjacent fan blades form a first flow channel, and each first flow channel causes the airflow to flow at the same speed;

and/or, the second blades of every two adjacent fan blades form a second flow channel, and each second flow channel gradually increases the flow speed of the airflow.

In some embodiments, the first flow channel is equal width flow channel;

and/or, the second flow channel includes a divergent flow channel and a convergent flow channel, and the outlet of the divergent flow channel is in communication with the inlet of the convergent flow channel.

In some embodiments, the ratio of the width at the inlet of the first flow channel to the width at the outlet of the first flow channel ranges from 1 to 1.05;

and/or, the ratio of the width at the inlet of the diverging flow channel to the width at the outlet of the convergent flow channel ranges from 1.3 to 1.7, and the ratio of the width at the inlet of the convergent flow channel to the width at the outlet of the convergent flow channel ranges from 2 to 2.4.

In some embodiments, the first blades of every two adjacent fan blades form a first flow channel; the second blades of every two adjacent fan blades form a second flow channel; the connecting blades of every two fan blades form a third flow channel; and each third flow channel smoothly connects the corresponding first flow channel with the corresponding second flow channel.

In some embodiments, the first flow channel, the third flow channel and the second flow channel are sequentially connected in an arc shape.

In some embodiments, each fan blade further includes a connecting blade which connects the first blade with the second blade, and the first blade, the connecting blade and the second blade form an integrated structure.

A fan, including the centrifugal fan blade described according to any of the above-mentioned technical features.

An air treatment device, including the fan described according to any of the above-mentioned technical features.

DETAILED DESCRIPTION OF THE INVENTION

Figure 1:
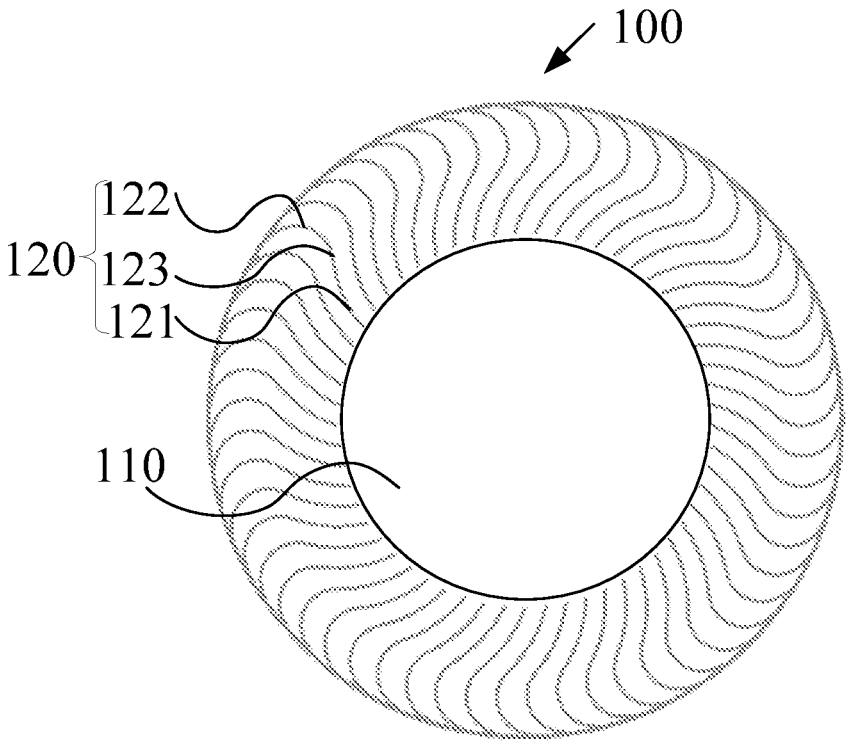
FIG. 1 is a schematic diagram of a centrifugal fan blade of an embodiment of the present disclosure.

In order to make the objectives, technical solutions and advantages of the present disclosure clearer, the air treatment device, the fan and the centrifugal fan blades of the fan of the present disclosure will be further described below in detail through embodiments. It should be understood that the specific embodiments described herein are only intended for explaining instead of limiting the present disclosure.

The serial numbers assigned to the components herein, such as "first", "second", etc., are only used to distinguish the described objects and do not have any sequence or technical meaning. The terms "connection" and "junction" mentioned in the present disclosure, unless otherwise specified, both include direct and indirect connection (junction). In the description of the present disclosure, it should be understood that the orientation or positional relationship indicated by the terms "upper", "lower", "front", "rear", "left", "right", "vertical", "horizontal", "top", "bottom", "inner", "outer", "clockwise", "counterclockwise", etc. is based on the orientation or positional relationship shown in the drawings, and is only for conveniently describing the present disclosure and simplifying the description, rather than indicating or implying that the referred device or element must have a specific orientation and be constructed and operated in a specific orientation, and therefore it cannot be understood as a limitation of the present disclosure.

In the present disclosure, unless expressly stated and defined otherwise, the first feature is "on" or "under" the second feature may mean that the first feature and the second feature have direct contact, or the first feature and the second feature have indirect contact through an intermediary. Moreover, the first feature is "above", "over", and "on" the second feature may mean that the first feature is directly above or diagonally above the second feature, or it only means that the horizontal height of the first feature is greater than that of the second feature. The first feature is "below", "under" and "underneath" the second feature may mean that the first feature is directly below or diagonally below the second feature, or it only means that the horizontal height of the first feature is less than that of the second feature.

Figure 2:
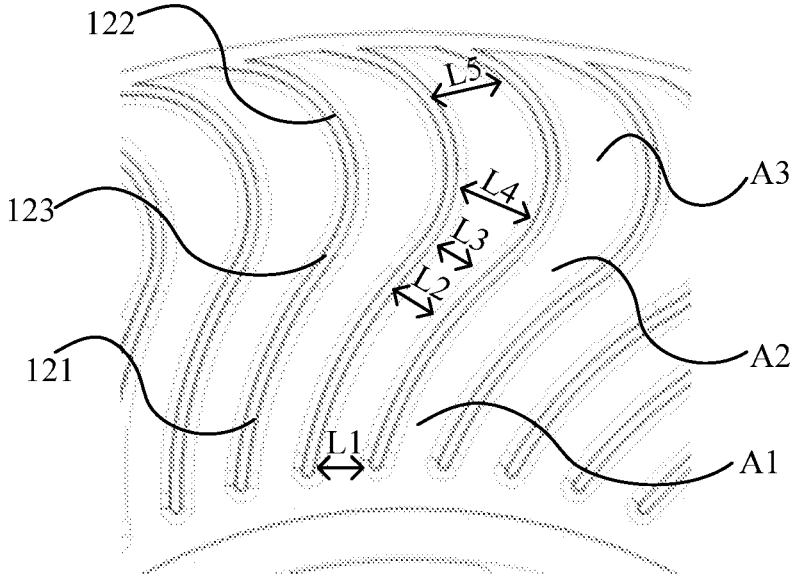
FIG. 2 is a partial enlarged view at one position of the centrifugal fan blade shown in FIG. 1.
Figure 3:
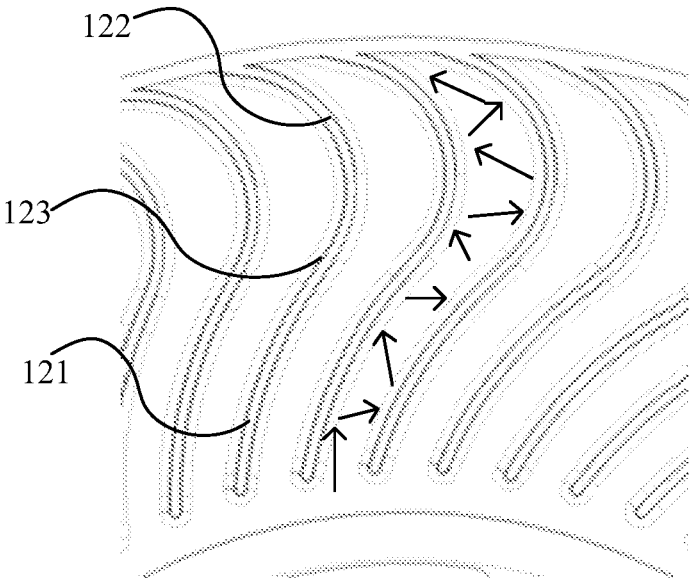
FIG. 3 is a partial enlarged view of the acoustic conduction path of the centrifugal fan blade shown in FIG. 1.

With reference of FIGS. 1 to 3, the present disclosure provides a centrifugal fan blade 100, and the centrifugal fan blade 100 is applied to a fan of an air treatment device and is configured to accelerate and pressurize the airflow to realize the output of the airflow. Certainly, the centrifugal fan blade 100 of the present disclosure can also be applied to devices such as air conditioners that require fans. The centrifugal fan blade 100 of the present disclosure can improve the air output efficiency while guaranteeing the static pressure resistance.

In the present disclosure, the centrifugal fan blade 100 includes a hub 110 and a plurality of fan blades 120, wherein the plurality of fan blades 120 are distributed around the periphery of the hub 110; the hub 110 has a bearing function and bears the plurality of fan blades 120; and the fan blades 120 guide the airflow to flow. When the centrifugal fan blade 100 rotates, the hub 110 is configured to drive the plurality of fan blades 120 thereon to rotate, and the fan blades 120 guide the airflow to flow, thereby realizing acceleration and pressurized output of the airflow. Moreover, the airflow enters the centrifugal fan blade 100 along the axial direction of the centrifugal fan blade 100 and flows out via the flow channels between the adjacent fan blades 120.

As shown in FIG. 1, each fan blade 120 includes a first blade 121 and a second blade 122 that is connected with the first blade 121; the radial bending direction of the first blade 121 is opposite to that of the second blade 122; moreover, the first blade 121 is in a backward blade form; and the second blade 122 is in a forward blade form.

In some embodiments, the first blade 121 and the second blade 122 are connected in series. In other words, the centrifugal fan blade 100 of the present disclosure realizes serial connection of two different blade forms on one fan blade 120, namely the first blade 121 in a backward blade form and the second blade 122 in a forward blade form are connected in series. Compared with cooperative use of the current forward fans and backward fans, the centrifugal fan blade 100 of the present disclosure can cancel the use of a connecting structure for the above-mentioned two parts, a frame, etc., and thus the overall structure of the centrifugal fan blade 100 is compact.

In some embodiments, the first blade 121 is connected with the hub 110, and the second blade 122 is disposed away from the hub 110. In other words, the first blade 121 in a backward blade form is located at the inlet of the centrifugal fan blade 100, and the second blade 122 in a forward blade form is located at the outlet of the centrifugal fan blade 100. Certainly, in other embodiments of the present disclosure, the first blade 121 in a backward blade form is located at the outlet of the centrifugal fan blade 100, and the second blade 122 in a forward blade form is located at the inlet of the centrifugal fan blade 100.

Moreover, the radial bending direction of the first blade 121 refers to the direction of an arc-shaped recess of the first blade 121, and the radial bending direction of the second blade 122 refers to the direction of an arc-shaped recess of the second blade 122. The radial bending direction of the first blade 121 is opposite to that of the second blade 122, that is, the direction of the arc-shaped recess of the first blade 121 is opposite to the direction of the arc-shaped recess of the second blade 122, so that the blade in a forward blade form and the blade in a backward blade form can be connected in series; meanwhile the flow channel formed by the adjacent fan blades 120 can further be bent, so that sound wave is reflected and refracted a plurality of times in the flow channel, thus sound energy is effectively dissipated, a blade channel sound insulation effect is achieved in a propagation route, the sound radiation energy is reduced, thereby achieving the effect of reducing noises.

As one implementable embodiment, the curvature radius of the first blade is greater than that of the second blade 122. In other words, the first blade 121 adopts a blade in a backward blade form with a larger curvature radius, and the second blade 122 adopts a blade in a forward blade form with a smaller curvature radius. Compared to a simplex blade form, the flow channel formed by the adjacent fan blades 120 is relatively narrow and long, so that the sound wave is refracted and reflected a plurality of times when propagating in the flow channel, thereby effectively dissipating the sound energy, achieving a sound insulation effect in the propagation route and reducing the sound radiation energy. Further, the ratio of the curvature radius of the first blade 121 to the curvature radius of the second blade 122 ranges from 3.4 to 3.8 in order to further reduce the sound radiation energy.

Furthermore, the blade entrance angle of the first blade 121 ranges from 64.5° to 68.5°. After the blade entrance angle of the first blade 121 is within the above-mentioned range, it can be matched with an airflow inlet angle, so that the airflow can flow along the extension direction of the first blade 121, which reduces the impact generated by the airflow to the first blade 121, thereby reducing the noises generated during running of the centrifugal fan blade 100 and guaranteeing stable running of the centrifugal fan blade 100. The blade exit angle of the second blade 122 ranges from 16° to 20°. The output direction of the air can be determined by the blade exit angle of the second blade 122, thus the airflow blows out along the second blade 122 with the blade exit angle to guarantee the static pressure resistance. The blade exit angle of the second blade 122 is within the above-mentioned range to guarantee the static pressure resistance requirement of the centrifugal fan blade 100.

After the first blade 121 at the inlet of the centrifugal fan blade 100 adopts a blade in a backward blade form, since the flow channel formed by the first blades 121 which are in a backward blade form is small in curvature rate, the attack angle of the airflow inlet can be reduced; the impact generated by the airflow to the blades is small; the impact loss at the inlet is reduced, so the natural impact noise is low, the energy loss is minimal, and the air output efficiency can be improved. Moreover, the first blade 121 is a blade in a backward blade form, which can also facilitate the adjustment of the entrance angle of the fan blade 120. It can be understood that the convenient adjustment here refers to the convenient adjustment of the blade entrance angle of a backward blade form; furthermore, the adjustment refers to the adjustment of the blade entrance angle of the first blade 121 in formation design of the centrifugal fan blade 100, so that the blade entrance angle of the first blade 121 is matched with the inlet airflow, thus during running of the centrifugal fan blade 100, the airflow can flow along the extension direction of the first blade 121, so direct impact generated by the airflow to the first blade 121 is reduced, thereby achieving the aim of reducing the noises generated during running of the centrifugal fan blade 100.

The second blade 122 at the outlet of the centrifugal fan blade 100 adopts a blade in a forward blade form, which can make the airflow outputted smoothly without swirling between adjacent fan blades 120, and can effectively inhibit the formation of a vortex area at the outlet, so that the airflow flows out along the fan blades 120, thereby improving the static pressure resistance of the centrifugal fan blade 100 and guaranteeing the air volume. Thus, to some units having relatively high requirements on static pressure resistance, the second blade 122 in a forward blade form can ensure that the air volume is not attenuated based on high static pressure resistance.

As an implementable embodiment, the fan blade 120 further includes a connecting blade 123 which smoothly connects the first blade 121 with the second blade 122. The connecting blade 123 achieves a connection function and builds a connection between the first blade 121 and the second blade 122. Meanwhile, the connecting blade 123 can realize smooth transition between the flow channel between the first blades 121 and between the second blades 122, thus making the airflow flow stably and reducing the loss. Optionally, the connecting blade 123 is a linear segment by which the first blade 121 is connected with the second blade 122.

As an implementable embodiment, the first blades 121 of every two adjacent fan blades 120 form a first flow channel A1. Each first flow channel A1 causes the airflow flow at the same velocity. Optionally, the first flow channel A1 is equal width flow channel. The equal width flow channel here means that the width between the inner walls of the first flow channel A1 is substantially equal everywhere. That is, the section width of the equal width flow channel is substantially constant, which can reduce the vortex areas in the first flow channel A1; as the separation of the airflow in the first flow channel A1 is reduced, energy dissipation between the fan blades 120 is reduced, so that the efficiency of the centrifugal fan blade 100 is improved.

In some embodiments, the width L1 at the inlet of the first flow channel is smaller than the width L2 at the outlet of the first flow channel. It can be understood that the inlet position of the first flow channel A1 refers to the position of the end where the first flow channel A1 is connected with the hub 110, and the outlet position of the first flow channel A1 refers to the position of the end where the first flow channel A1 is away from the hub 110. In this embodiment, the outlet position of the first flow channel A1 refers to the position connected with the connecting blade 123. In other words, the width from the end of the first flow channel A1 connected with the hub 110 to the end far away from the hub 110 is substantially equal, so that the first flow channel A1 forms a constant-velocity flow channel. Thus, the airflow can realize uniform-velocity flowing when flowing in the first flow channel A1, thereby reducing the loss. Moreover, the width refers to the width between two adjacent first blades 121.

Further, the ratio of the width L1 at the inlet of the first flow channel A1 to the width L2 at the outlet of the first flow channel A1 ranges from 1 to 1.05. By constructing the first blades 121 according to the design parameter, the width between adjacent first blades 121 is substantially the same, and the air flow velocity of the first flow channel A1 is ensured to be consistent. Furthermore, the ratio of the width at any position of the first flow channel A1 to the width L1 at the inlet of the first flow channel A1 ranges from 1 to 1.05. Thus, the first flow channels A1 are ensured to be constant-velocity flow channels.

As an implementable embodiment, the second blades 122 of every two adjacent fan blades 120 form a second flow channel A2. Each second flow channel A2 gradually increases the flow velocity of the airflow. Optionally, the second flow channel include a divergent flow channel and a convergent flow channel, and the outlet of the divergent flow channel is in communication with the inlet of the convergent flow channel. In the divergent flow channel, the width between the inner walls of the second flow channel A2 is gradually increased, and in the convergent flow channel, the width between the inner walls of the second flow channel A2 is gradually reduced. In other words, the second flow channel A2 formed by the adjacent second blades 122 are gradually divergent and then convergent.

The divergent flow channel is connected with the first flow channel A1 formed by the first blades 121, and the smooth connection between the divergent flow channel and the first flow channel A1 can reduce the loss of the flow channel to increase the energy of output air, thereby improving the static pressure resistance. The width between the inner walls of the convergent flow channel close to the air outlet side is reduced, the flow area of the same air volume is reduced, which will correspondingly increase the velocity of the airflow at the outlet, and thus the convergent blade form can effectively eliminate unevenness of the flow velocity at the outlet and reduce diffusion of the airflow, thereby weakening the jet-wake influence at the outlet.

The width L3 at the inlet of the second flow channel A2 is greater than the width L5 at the outlet of the second flow channel A2. It can be understood that the width at the inlet of the second flow channel A2 refers to that at the position of the end of each second flow channel A2 close to the corresponding first flow channel A1; in this embodiment, the width at the inlet of the second flow channel A2 refers to that at the position of the joint of each second blade 122 and the corresponding connecting blade 123; and the outlet of each second flow channel A2 refers to the tail end of the corresponding fan blade 120. In other words, the width from the end of each second flow channel A2 connected with the corresponding connecting blade 123 to the end far away from the corresponding connecting blade 123 is firstly large and then small, so that the second flow channel A2 forms an accelerating flow channel. Thus, when the airflow flows in the second flow channels A2, the second flow channels A2 can accelerate the airflow.

Further, the ratio of the width at the inlet of the divergent flow channel to the width at the outlet of the convergent flow channel ranges from 1.3 to 1.7, and the ratio of the width at the inlet of the convergent flow channel to the width at the outlet of the convergent flow channel ranges from 2 to 2.4. Namely, the width L3 at the inlet of the second flow channel A2 to the width L5 at the outlet of the second flow channel A2 ranges from 1.3 to 1.7. The ratio of the width at the inlet of the convergent flow channel to the width at the outlet of the second flow channel A2 ranges from 2 to 2.4. Moreover, as shown in FIG. 2, the width in the second flow channel A2 is firstly increased and then reduced to achieve acceleration of the airflow.

Optionally, the length of the first blade 121 along the radial direction is equal to that of the second blade 122 along the radial direction. If the second blade 122 is too short, it will be difficult to form an acceleration process of the airflow and the static pressure resistance will be insufficient. If the second blade 122 is too long, although the static pressure resistance will be improved, the noise of the airflow will be large and the efficiency will be greatly reduced as well. Moreover, due to the limitation of the diameter of the centrifugal fan blade 100, if the first blade 121 is too long, the corner at the joint of the first blade 121 and the second blade 122 will be too large, the blade profile line will be not smooth, and the strong airflow at the corner will form a concentrated vortex area in the flow channel, resulting in swirling of the airflow in the flow channel, which will cause a disadvantage for air output. Therefore, the setting of equal length of the first blade 121 and the second blade 122 can reduce noise, guarantee efficiency, and facilitate flowing of the airflow while guaranteeing the static pressure resistance.

As an implementable embodiment, the connecting blades 123 of every two adjacent fan blades 120 form a third flow channel A3, and each third flow channel A3 smoothly connects the first flow channel A1 with the corresponding second flow channel A2. Thus, the flow channels for the airflow can be ensured to be smooth, the flow loss of the airflow can be reduced, and the output air volume can be guaranteed. Moreover, the width at the inlet of the third flow channel A3 is less than the width L3 at the inlet of the second flow channel A2, and the width at the inlet of the third flow channel A3 is greater than the width L2 at the outlet of the first flow channel A1. In other words, the width between the third flow channel A3 is gradually increased along the flow direction of the airflow so as to achieve smooth connection between the first flow channel A1 and the second flow channel A2.

As shown in FIG. 3, optionally, the first flow channel A1, the third flow channel A3 and the second flow channel A2 are sequentially and smoothly connected in an arc shape, thereby guaranteeing smooth flow channels and low loss.

Further optionally, the first blade 121, the connecting blade 123 and the second blade 122 form an integrated structure. Thus, the fan blade 120 can be easy to process and shape, reliable connection is guaranteed, and meanwhile the assembly efficiency can also be improved. Moreover, the first blade 121, the connecting blade 123, the second blade 122 and the hub 110 may also be integrally formed.

The design parameters of the centrifugal fan blade 100 of a specific embodiment of the present disclosure are as follows: the hub ratio of the first blade 121 (the ratio of the diameter of the end where the first blade 121 is connected with the hub 110 to the diameter of the end where the first blade 121 is connected with the connecting blade 123) is 0.8125; the hub ratio of the second blade 122 (the ratio of the diameter of the end where the second blade 122 is connected with the connecting blade 123 to the diameter of the tail end of the second blade 122) is 0.6; the blade entrance angle of the first blade 121 is 66.5°; the blade exit angle of the second blade 122 is 18.3°; the central angle of the first blade 121 is 28; the central angle of the second blade 122 is 117°; the arc radius of the first blade 121 is 64.7 mm; and the arc radius of the second blade 122 is 17.8 mm. Thus, the airflow can flow into the centrifugal fan blade 100 along the first blade 121 to reduce the impact caused by the airflow to the fan blade 120 at the inlet, reduce the impact noise, can also improve the flowing of the airflow at the inlet of the fan blade 120, inhibit flow division and increase the output air volume; the second blade 122 can inhibit the formation of vortex at the outlet, and improve the static pressure resistance, so that the centrifugal fan blade 100 guarantees the air output efficiency as well as has a compact structure and reduces the noises generated during running of the centrifugal fan blade 100.

The present disclosure further provides a fan, including a motor and a centrifugal fan blade 100. An output shaft of the motor is connected with the hub 110 of the centrifugal fan blade 100 to realize rotation driving of the centrifugal fan blade 100, thereby realizing accelerated output of the airflow. After the fan of the present disclosure adopts the above-mentioned centrifugal fan blade 100, it can improve the static pressure resistance, guarantee the air output efficiency, reduce the noises generated during running of the fan, and guarantee stable and reliable running of the fan.

The present disclosure further provides an air treatment device, including a filter component and a fan; the filter component may be arranged at the air inlet end of the fan or at the air outlet end of the fan; the filter component filters the air to achieve purification and dust removal of the air; and the fan realizes accelerated flowing of airflow. After the air treatment device of the present disclosure adopts the above-mentioned fan, it can improve the static pressure resistance, guarantee the air output efficiency, reduce the noises generated during running of the fan, guarantee stable and reliable running of the fan, and improve the comfort level of the user during use.

The technical features of the above-mentioned embodiments can be combined randomly; in order to make the description concise, not all possible combinations of the various technical features in the above-mentioned embodiments are described, however, as long as there is no contradiction in the combinations of these technical features, all should be considered as the scope of this specification.

The above-mentioned embodiments only express several implementation modes of the present disclosure, and the description thereof is relatively specific and detailed, but it should not be understood as a limitation to the patent scope of the present disclosure. It should be noted that, for those of ordinary skill in the art, without departing from the concept of the present disclosure, a plurality of modifications and improvements can be made as well, which all fall within the protection scope of the present disclosure. Therefore, the protection scope of the present disclosure depends on the claims described.

The invention claimed is:

1. A centrifugal fan blade, comprising a hub and a plurality of fan blades distributed around a periphery of the hub;

wherein each fan blade of the plurality of fan blades comprises a first blade and a second blade connected with the first blade;

each first blade is in a backward blade form; and each second blade is in a forward blade form;

wherein a ratio of the curvature radius of the first blade to the curvature radius of the second blade ranges from 3.4 to 3.8.

2. The centrifugal fan blade according to claim 1, wherein the first blade and the second blade are connected in series.

3. The centrifugal fan blade according to claim 2, wherein the first blade is connected with the hub, and the second blade is disposed away from the hub.

4. The centrifugal fan blade according to claim 1, wherein a curvature radius of the first blade is greater than that of the second blade.

5. The centrifugal fan blade according to claim 3, wherein a blade entrance angle of the first blade ranges from 64.5° to 68.5°; or a blade exit angle of the second blade ranges from 16° to 20°; or the blade entrance angle of the first blade ranges from 64.5° to 68.5° and the blade exit angle of the second blade ranges from 16° to 20°.

6. The centrifugal fan blade according to claim 1, wherein each fan blade of the plurality of fan blades further comprises a connecting blade which smoothly connects the first blade with the second blade.

7. The centrifugal fan blade according to claim 1, wherein the first blades of every two adjacent fan blades of the plurality of fan blades form a first flow channel, and each first flow channel is configured to cause an airflow to flow at the same velocity; or the second blades of every two adjacent fan blades of the plurality of fan blades form a second flow channel, and each second flow channel is configured to gradually increase the flow velocity of the airflow; or the first blades of every two adjacent fan blades of the plurality of fan blades form a first flow channel, and each first flow channel is configured to cause the airflow to flow at the same velocity and the second blades of every two adjacent fan blades of the plurality of fan blades form a second flow channel, and each second flow channel is configured to gradually increase the flow velocity of the airflow.

8. The centrifugal fan blade according to claim 7, wherein the first flow channel is an equal width flow channel; or the second flow channel comprises a divergent flow channel and a convergent flow channel, and an outlet of the divergent flow channel is in communication with an inlet of the convergent flow channel; or the first flow channel is an equal width flow channel and the second flow channel comprises a divergent flow channel and a convergent flow channel, and the outlet of the divergent flow channel is in communication with the inlet of the convergent flow channel.

9. The centrifugal fan blade according to claim 8, wherein a ratio of a width at an inlet of the first flow channel to a width at an outlet of the first flow channel ranges from 1 to 1.05; or a ratio of the width at an inlet of the diverging flow channel to the width at an outlet of the convergent flow channels ranges from 1.3 to 1.7, and the ratio of the width at the inlet of the convergent flow channel to the width at the outlet of the convergent flow channel ranges from 2 to 2.4; or the ratio of the width at the inlet of the first flow channel to the width at the outlet of the first flow channel ranges from 1 to 1.05 and the ratio of the width at the inlet of the diverging flow channel to the width at the outlet of the convergent flow channels ranges from 1.3 to 1.7, and the ratio of the width at the inlet of the convergent flow channel to the width at the outlet of the convergent flow channel ranges from 2 to 2.4.

10. The centrifugal fan blade according to claim 6, wherein the first blades of every two adjacent fan blades of the plurality of fan blades form a first flow channel, and the second blades of every two adjacent fan blades of the plurality of fan blades form a second flow channel; and the connecting blades of every two adjacent fan blades of the plurality of fan blades form a third flow channel, and each third flow channel smoothly connects the first flow channel with a corresponding second flow channel.

11. The centrifugal fan blade according to claim 10, wherein the first flow channel, the third flow channel and the second flow channel are sequentially connected in an arc shape.

12. The centrifugal fan blade according to claim 1, wherein each fan blade of the plurality of fan blades further comprises a connecting blade which smoothly connects the first blade with a corresponding second blade, and the first blade, the connecting blade and the second blade form an integrated structure.

13. A fan, comprising the centrifugal fan blade according to claim 1.

14. An air treatment device, comprising the fan according to claim 13.

* * * * *